US005706749A

United States Patent [19]

Stepanova

[11] Patent Number: 5,706,749

[45] Date of Patent: Jan. 13, 1998

[54] METHOD FOR PRODUCING A LEATHER ARTICLE AND LEATHER ARTICLE THEREBY OBTAINED

[76] Inventor: Svetlana Dmitrievna Stepanova, 20, korp. 2, 7, Sheremetievskaya Ul., Moscow, Russian Federation, 127521

[21] Appl. No.: 525,711

[22] PCT Filed: Mar. 21, 1994

[86] PCT No.: PCT/RU94/00054

§ 371 Date: Sep. 21, 1995

§ 102(e) Date: Sep. 21, 1995

[87] PCT Pub. No.: WO94/21829

PCT Pub. Date: Sep. 29, 1994

[30] Foreign Application Priority Data

Mar. 23, 1993 [RU] Russian Federation ..... 93014918

[51] Int. Cl.[6] ..... D05B 97/00

[52] U.S. Cl. ..... 112/475.09; 112/475.21; 112/439; 428/542.2

[58] Field of Search ..... 112/475.01, 475.08, 112/475.09, 475.18, 475.21, 104, 439, 440, 441; 2/244, 246; 428/906.6, 542.2

[56] References Cited

U.S. PATENT DOCUMENTS 4,073,299 2/1978 Murata ..... 112/439 X
4,495,230 1/1985 Ellwein ..... 428/906.6 X
4,578,318 3/1986 Schoch et al. ..... 428/542.2 X
5,358,763 10/1994 Zinbarg ..... 428/542.2 X

FOREIGN PATENT DOCUMENTS 1463279 11/1966 France .
1760967 3/1991 U.S.S.R. .
230611 2/1924 United Kingdom .

OTHER PUBLICATIONS

Course of Women's Handworks, Ch. 8 "Applied Stitchcraft," 1992, pp. 152–153. (Orig. and translation).

*Primary Examiner*—Peter Nerbun
*Attorney, Agent, or Firm*—David L. Garrison

[57] ABSTRACT

A method is disclosed wherein a pattern is drawn on a template (1), and separate leather components (3) are prepared such that their outlines match the elements (2) of the motif. Each of the various components (3) is joined to the adjacent component at the contact points therebetween via reinforcing members (4), and apertures between said components (3) are filled with a tracery (5) of crossed threads with their ends joined to the edges of adjacent components (3).

10 Claims, 2 Drawing Sheets

METHOD FOR PRODUCING A LEATHER ARTICLE AND LEATHER ARTICLE THEREBY OBTAINED

FIELD OF THE INVENTION

The invention relates generally to production of consumer goods and, more specifically, of haberdashery, and can be used in production of leather garments, footwear, hats, bags and objects of applied art.

BACKGROUND OF THE INVENTION

Known in the art is a method for producing a leather article by making separate leather components, each having a closed outline, and flat joining each of the separate components to an adjacent one (FR,A,2029984).

In this method the separate leather components are glued on a flexible underlying material, the components being butted without empty spaces therebetween on the underlying material so as to produce a one-piece cloth.

The aforementioned method allows the use of commercially small size separate leather components, such as cuttings. Still it is impossible to produce articles having empty spaces inasmuch as the separate components are glued on a common underlying material and they are chosen with similar outlines which reduces a decorative value.

By some methods, articles are produced by cutting a perforated pattern in a piece of leather (FR,A,1463279; FR,A,1565893).

All those methods are relatively efficient, but result in a great number of cuttings and articles of poor decorative appearance. Typically, such methods are used to produce rough leather articles having a simple ornamental pattern, such as belts, ornaments for bags, since it is difficult to provide a lining conforming to the perforated pattern of a piece of leather.

Articles, produced by such methods, are of low decorative value due to small perforations, whereas large empty spaces reduce drastically resistance of the article to deformations along thin leather bridges between the empty spaces.

"Course of woman's handworks" (Moscow, Tolika, Russian Writer Publishers, 1992, pp.152–153, 157–158) discloses a method for producing leather articles, comprising plotting a pattern with empty spaces between elements thereof on a template, making separate leather components with closed outlines conforming to elements of the pattern.

The same book describes a leather article made of separate leather components joined in accordance with a pattern, with empty spaces therebetween.

According to the method above, separate components are sewed on a common underlying material, i.e. by an application technique allowing the use of small size separate components, such as cuttings. However, use of a common underlying material prevents the provision of apertures between separate components, which reduces decorative value and hygiene characteristics of the article due to lack of air admission, essential for some types of summer garments, footwear, hats, etc.

SUMMARY OF THE INVENTION

It is an object of the present invention to provide a method for producing a leather article wherein separate components are joined so as to provide empty spaces between them in accordance with a pattern of any complexity, and a leather article with empty spaces maintains resistance to deformations, and, therefore, to improve an openwork and decorative value of a leather article, its quality and hygiene characteristics.

The aforementioned object is attained by a method for producing a leather article, including drawing a pattern with empty spaces forming apertures between elements thereof on a template, making separate leather components having closed outlines conforming to the elements of the pattern, wherein the pattern is composed of elements each contacting adjacent elements, each separate component is joined to an adjacent component at contact points therebetween via fastening members arranged perpendicular to a tangent to a contact point of separate components, the apertures between the separate components being filled with a tracery of crossed threads with its ends joined to edges of adjacent components.

According to one embodiment of the invention, separate elements have different outlines and different sizes.

According to another embodiment of the invention, the template is a gauge with darts.

Alternatively, the template is three-dimensional.

In the next embodiment of the invention separate components are of different colour.

In accordance with another embodiment of the invention the fastening member is a thread seam.

Alternatively, the fastening member comprises glass adornments sewed to the edges of separate components.

Alternatively, the fastening member comprises metal accessories securing the edges of separate components.

It is also advantageous to provide the separate components with an embroidery or bijouterie attached thereto.

In one more embodiment of the invention, before joining separate components together, a lining is glued on a reverse side thereof.

In accordance with a further embodiment of the invention, wherein a lining is glued on a reverse side, each of the separate components is provided with a prominent stitch along an outline.

The object of the invention is further attained by a leather article consisting of separate leather components joined together in accordance with a pattern, with apertures threbetween, wherein adjacent separate leather components are joined at contact points via a fastening member arranged perpendicular to a tangent to contact points of adjacent separate leather components, whereas the apertures between adjacent separate leather components are filled with a tracery of crossed threads which ends are joined to edges of adjacent separate leather components.

In accordance with one embodiment of the invention, a separate component is provided with a lining on a reverse side thereof and with a thread seam along an outline of a separate leather component to join it to the lining.

There can be further provided a prominent thread stitch.

The object of the invention is attained by joining separate components at contact points of their outlines and filling apertures with a tracery of crossed threads.

The advantages of the present invention will become more apparent from the following description of the preferred embodiments of practicing the invention, taken in conjunction with accompanying drawings.

DESCRIPTION OF PREFERRED EMBODIMENTS OF THE INVENTION

A pattern, having apertures between elements 2 thereof, is drawn on a template 1, each of the elements 2 contacting adjacent elements 2.

Figure 1:
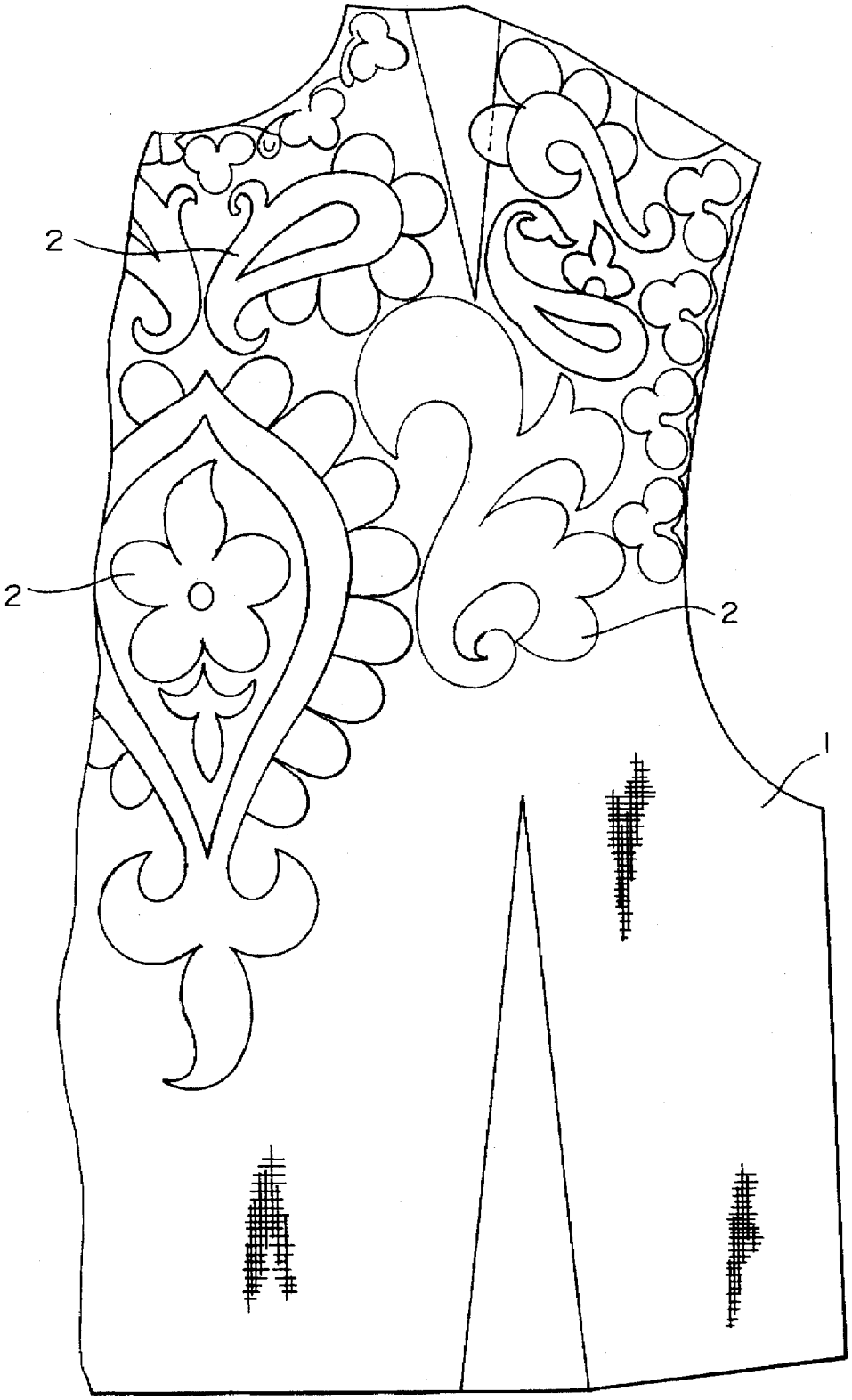
FIG. 1 is a view of a gauge with darts, having a pattern motif enlarged for clearness.
Figure 2:
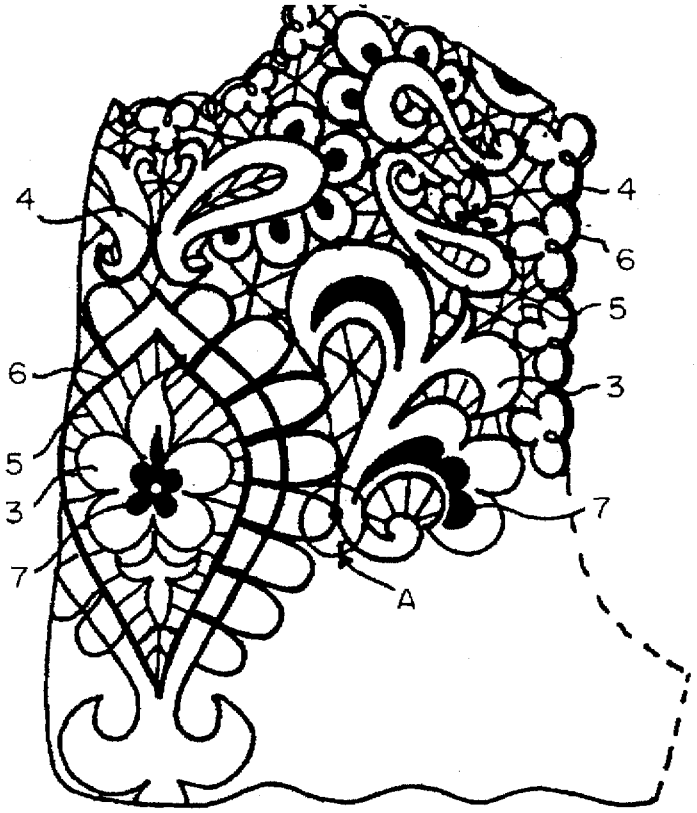
FIG. 2 shows a leather article with separate leather components enlarged for clearness.

Each of the pattern elements 2 has a closed outline for making separate components 3 in accordance with them (FIG. 2).

Where separate components 3 (FIG. 2) are made of cuttings from previous production of leather articles, the largest sizes of elements 2 of the pattern (FIG. 1) should correspond to dimensions of the cuttings. Where the article is made of one piece of leather, sizes of elements 2 are unlimited.

The separate components are further flat joined (FIGS. 2, 3, 4) by fastening members 4 in accordance with the pattern. Apertures between separate components 3 (FIG. 2) are filled with a tracery 5 of crossed threads, such as bridges. Ends of the tracery 5 are joined to edges of adjacent separate components 3.

Inasmuch as the fastening members 4 (FIG. 3) are arranged perpendicular to a tangent to a contact point of separate components 3, the article maintains its three-dimensional and plane form under deformation.

Figure 3:
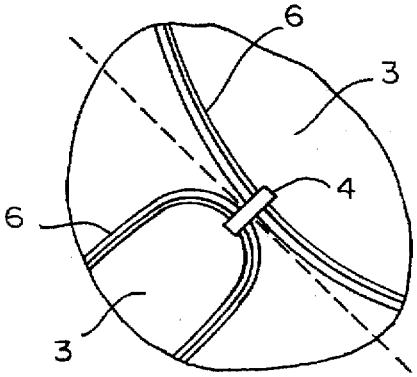
FIG. 3 illustrates joining of separate components by a thread seam, part A of FIG. 2.
Figure 4:
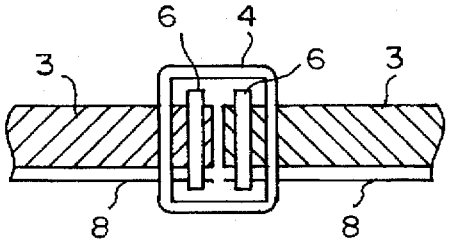
FIG. 4 is a side view of FIG. 3.

FIGS. 2, 3 and 4 further illustrate a prominent stitch 6, FIG. 2 depicting an embroidery 7. A line 8 is shown in FIG. 4. In FIG. 2 the outline of the article is shown by dot-and-dash line.

Depending on a pattern chosen (FIG. 2), separate components 3 are made conforming to elements 2 of different outlines and different sizes, which improves decorative appearance of the article. Patterns for each particular article can be designed in different artistic styles using, for example, folk motifs or any other, which essentially improves an aesthetic appearance of the article and artistic impression thereof.

Owing to a flat joint of separate components 3 (FIGS. 3, 4), rather then a lap joint, the leather article maintains its plane form, which is of importance both for producing garments, and applied art objects, such as decorative table clothes.

Separate components 3 can be of different color, further improving a decorative appearance of the article, and owing to a deep saturation of colors on leather, a combination of different colors would increase contrast of tints of separate components 3 and decorative impression of the article.

A template 1 according to the present invention can be a gauge with darts (FIG. 1) which could not be implemented in prior art methods of cutting perforations in a piece of leather (FR,A,1463279,1545893) due to a problem of joining darts, matching to a pattern.

The present invention enables the production of shaped articles, not breaking a pattern insofar as separate components 3 (FIG. 2) can have different outlines and different sizes. Therefore, separate components 3 are easily joined along darts and sewed at contact points along the darts by fastening members 4 which is very important for making shaped leather articles, such as garments.

The template can be three-dimensional, for example, for producing harbedashery, such as hats, bags, and footwear.

Use of a tracery 5 of crossed threads is an essential feature of the present invention. In addition to improving a decorative appearance and openwork of the article, it further enables an increase in strength of a leather article under deformations and maintenance of a shaped form of articles. A tracery 5 of crossed threads further joins edges of the separate components 3, which is very important for producing articles of high-quality thin leather, since it prevents bending of edges of separate articles 3.

A fastening member 4 can comprise a thread seam made perpendicular to a tangent to a contact point of separate components 3. Use of a thread seam as a fastening member allows to increase empty spaces between separate components 3, i.e an openwork of the article, and to improve resistance to deformations since the deformation load is received directly by the fastening member 4, rather then by a thin connecting strip of leather which is easily damaged and worn through. This feature is important for producing garments of thin leather. Thus, at places enduring high deformations there can be aranged large separate components 6 or fastening members 4. At the same time, the thread seam does not limit flexibility of the leather article.

The fastening member 4 can comprise glass adornments sewed to the edges of separate components 3. Such glass adornments can be used separately or in conjunction with the thread seam, in this case some separate components 3 are joined by the adornments, and other components by a thread seam, which further improves strength and decorative appearance.

Metal accessories can be also used as fastening members 4, increasing essentially strength of the article, however, reducing a flexibility thereof. They can be used, for example, for producing bags, footwear and other shaped articles where it is required to maintain the article shape under relatively high loads. Metal accessories consist of plates and when butting separate components 3, ends of the plates are riveted or otherwise attached at some distance from edges of separate components 3.

To further improve a decorative appearance of the leather article (FIG. 2), separate components 3 can be provided with an embroidery 7 or with various bijouterie, such as application, laces, etc.

According to the embodiment of the invention (FIG. 4), a lining 8, necessary for garments, is glued on a reverse side of the separate components 3. In this case, each separate component 3 can be provided along the outline thereof (FIG. 3) with a prominent stitch 6. The prominent stitch 6 additionally fixes the lining 8 and increases the edge strength of the separate component 3. Inasmuch as the stitch 6 is prominent, it gives an impression of a solid lace to the article, and where the stitch 6 is of different color than the separate component 3, it further improves a decorative appearance of the entire article.

The method according to the present invention can be implemented by conventional production equipment, providing high output of desiged models of garments and other articles. The cost of such articles can be reduced owing to a possibility to use cuttings of leather production.

The leather article (FIG. 2), wherein adjacent separate components 3 are joined by fastening members 4 and the apertures therebetween are filled with a tracery 5 of crossed threads, is strong, resistant to various deformations and possesses a decorative appearance. Strength of the article, having large empty spaces between separate components thereof, is not inferior to that of the articles made of one piece of leather.

Industrial Applicability

The method in accordance with the present invention and the article produced thereby can be most successfully utilized in consumer goods production, for making leather garments, footwear, hats, bags, harberdashery and objects of applied art.

I claim:

1. A method for producing a leather article, including drawing a pattern with apertures between elements (2) thereof on a template (1), making separate leather components (3) having closed outlines conforming to the elements (2) of the pattern, characterized in that the pattern is composed of elements (2) each contacting adjacent elements (2), joining each separate leather component (3) in accordance with the pattern to an adjacent component at contact points therebetween via fastening members (4) arranged perpendicular to a tangent to a contact point of separate components (3), and filling the apertures between the separate components (3) with a tracery (5) of crossed threads with their ends joined to edges of adjacent components (3).

2. A method for producing a leather article according to claim 1, wherein the separate components (3) have different outlines and different sizes.

3. A method for producing a leather article according to claim 1, wherein the template (1) is a gauge with darts.

4. A method for producing a leather article according to claim 1, wherein the template (1) is three-dimensional.

5. A method for producing a leather article according to claim 1, including a gluing a lining (8) on a reverse side of the separate components (3) before joining them together.

6. A method for producing a leather article according to claim 1, including stitching a thread sewn through each of the separate components (3) along an outline.

7. A leather article consisting of separate leather components (3) joined together in accordance with a pattern, with apertures therebetween, characterized in that adjacent leather components (3) are joined at contact points via a fastening member (4) arranged perpendicular to a tangent to contact points of adjacent separate leather components (3), and further that the apertures between separate components (3) are filled with a tracery (5) of crossed threads having ends which are joined to edges of adjacent separate leather components (3).

8. A leather article according to claim 7, wherein a lining (8) is provided on a reverse side of the separate components (3), and a thread seam (6) is provided along the outlines of the separate leather components (3) to join them to the lining (8).

9. A leather article according to claim 8, wherein the thread seam (6) is a prominent stitch.

10. A method for producing a leather article according to claim 5, wherein each of the separate components (3) is provided with a thread seam (6) along an outline.

* * * * *